United States Patent [19]

Poisson

[11] 4,184,247

[45] Jan. 22, 1980

[54] SAFETY RAZOR

[75] Inventor: Norman D. Poisson, Andover, Mass.

[73] Assignee: The Gillette Company, Boston, Mass.

[21] Appl. No.: 940,391

[22] Filed: Sep. 7, 1978

[51] Int. Cl.[2] ..... B26B 21/14

[52] U.S. Cl. ..... 30/59; 30/58; 30/75

[58] Field of Search ..... 30/58, 59, 75

[56] References Cited

U.S. PATENT DOCUMENTS

| | | | |
|---|---|---|---|
| 1,940,563 | 12/1933 | Porter et al. . | |
| 1,996,503 | 4/1935 | Darby . | |
| 2,030,658 | 2/1936 | Schodlbauer | 30/58 |
| 2,052,395 | 8/1936 | Geissler . | |
| 2,395,272 | 2/1946 | Hellmann . | |
| 2,657,460 | 11/1953 | Cerino et al. . | |
| 2,703,927 | 3/1955 | Green . | |
| 3,154,852 | 11/1964 | Westlake | 30/59 |
| 3,259,978 | 7/1966 | Weichselbaum | 30/59 |
| 3,608,193 | 9/1971 | Jerusalmi . | |
| 3,650,027 | 3/1972 | Stephenson et al. . | |
| 3,653,123 | 4/1972 | King et al. . | |
| 3,675,323 | 7/1972 | Braginetz . | |
| 3,972,115 | 8/1976 | Ross . | |

FOREIGN PATENT DOCUMENTS

| | | |
|---|---|---|
| 386890 | 1/1933 | United Kingdom . |
| D. 943898 | 11/1969 | United Kingdom . |

*Primary Examiner*—Othell M. Simpson
*Assistant Examiner*—J. T. Zatarga
*Attorney, Agent, or Firm*—Richard A. Wise; Scott R. Foster

[57] ABSTRACT

A safety razor comprising a handle portion, a platform portion molded integrally with the handle portion, and a cap portion molded integrally with the platform portion, a hinge portion interconnecting the platform portion and the cap portion, the cap portion being adapted by flexure of the hinge portion to overlie the platform portion, the cap portion being adapted for connection to the platform portion to securely fasten the cap portion to the platform portion.

10 Claims, 12 Drawing Figures

SAFETY RAZOR

BACKGROUND OF THE INVENTION

1. Field of the Invention

This invention relates to safety razors and is directed more particularly to low cost, molded, one-piece razors.

2. Description of the Prior Art

Razors made entirely of plastic, less the blade means, are known in the prior art. For example, U.S. Pat. No. 3,675,323 issued July 11, 1972 to Paul A. Braginetz discloses an all-plastic double edge razor in which the handle and platform portions are molded as one member, and a cap portion, molded separately, is joined to the platform portion.

There have been attempts to even further simplify the manufacture of such razors by having the cap portion molded integrally to the platform portion by means of a living hinge. The living hinge permits the cap portion, by flexure of the hinge to be brought to a position overlying the platform portion, the cap portion then being typically snapped-fitted to the platform portion, with blade means therebetween, the snap-fit means being disposed at the end of the razor head remote from the living hinge. In such embodiments, a shortcoming has been that the living hinge has been depended upon as a fastening element for retaining the cap portion clamped to the platform portion. Almost invariably, the living hinge fails to exercise sufficient clamping force to securely retain the cap portion in fixed position relative to the platform portion, particularly after a period of time.

Razors other than of molded material have been provided with pivotally mounted cap portions, as for example, those shown in U.S. Pat. Nos. 3,650,027, issued Mar. 21, 1972 to Charles F. Stephenson, and 3,653,123 issued Apr. 4, 1972 to Philip W. King, which disclose razor cap portions pivotally mounted at one end thereof, the razors being provided with means axially of the handle for clamping the cap portion in a position overlying the platform portion. In U.S. Pat. No. 1,940,563, issued July 29, 1932 to F. Porter, et al, a pivotally mounted cap portion is secured to the platform portion at one end by its hinge mechanism and at the other end by a locking structure.

SUMMARY OF THE INVENTION

An object of the present invention, is to provide a one-piece molded safety razor in which a cap portion is connected to a platform portion by means of a living hinge, the cap and platform portions having interlocking structure at either end thereof for securely fastening the cap portion to the platform portion.

With the above and other objects in view, as will hereinafter appear, a feature of the present invention is the provision of a safety razor comprising a handle portion, a platform portion molded integrally with the handle portion, a cap portion molded integrally with the platform portion, a hinge portion at a first end of the platform portion and a first end of the cap portion interconnecting the platform portion and the cap portion, the cap portion having first cap locking means at the first end thereof and second cap locking means at a second end thereof, the platform portion having first platform locking means at the first end thereof and second platform locking means at a second end thereof, the cap portion being adapted by flexure of the hinge portion to overlie the platform portion, the first cap locking means being engageable with the first platform locking means to securely fasten the first cap end to the first platform end, and the second cap locking means being engageable with the second platform locking means to securely fasten the second cap end to the second platform end.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
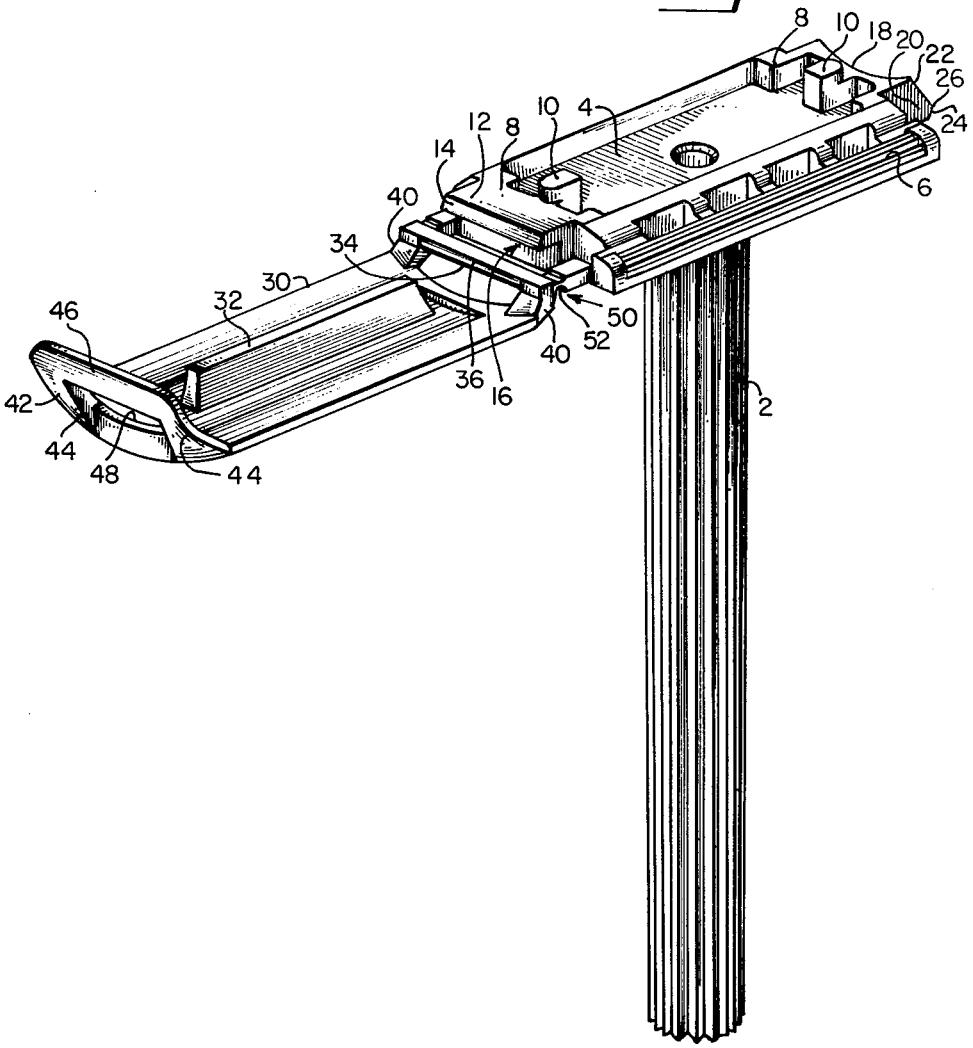
FIG. 1 is a perspective view of one form of safety razor illustrative of an embodiment of the invention.

Referring to the drawings, it will be seen that the safety razor of the present invention includes a handle portion 2 of molded plastic material. A platform portion 4 is molded integrally with the handle portion 2 and extends transversely thereof.

Figure 8:
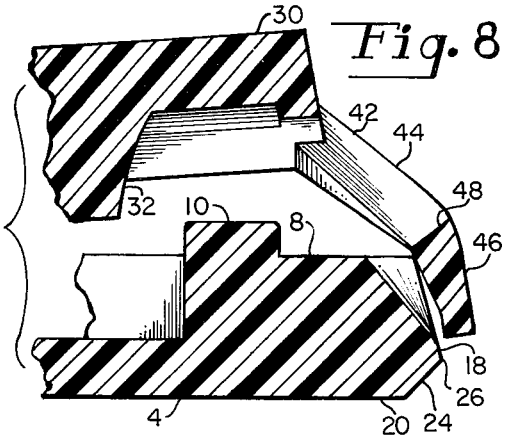
FIG. 8 is similar to FIG. 7 but showing the components in a different position.
Figure 12:
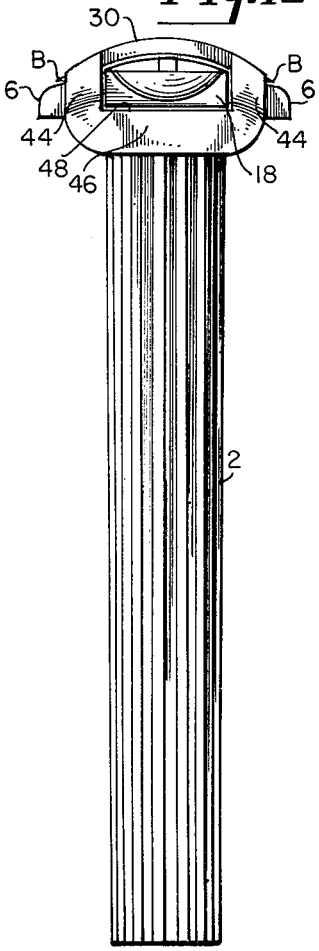
FIG. 12 is a side elevational view.
Figure 9:
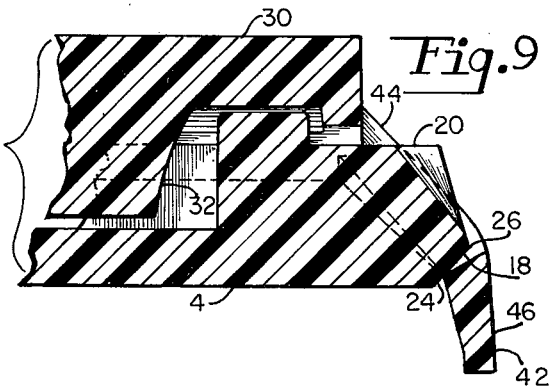
FIG. 9 is similar to FIG. 8 but showing the components in a still different position.

The platform portion 4 includes guard portions 6, blade seat portions 8 for receiving a razor blade B, and upstanding projection 10 adapted to engage a center opening C in the razor blade. The platform portion 4 is further provided at a first end thereof with a first platform locking means 12 (FIGS. 3–5) which comprises an outwardly extending lip 14 having a rounded edge 15 and defining a recess 16 having walls 17, 19 normal to each other. The platform portion 4 is further provided at a second end thereof (FIGS. 7–9) with a second platform locking means 18 comprising an endwise extension 20 having a first inclined surface 22 and a second inclined surface 24 cooperatively defining a ridge 26.

Figure 7:
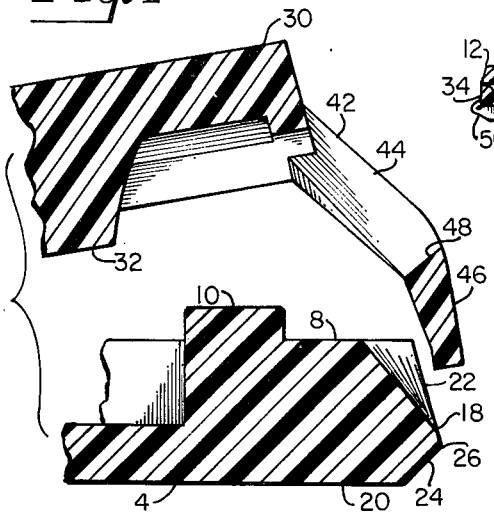
FIG. 7 is an enlarged sectional view of a second locking portion of the razor.
Figure 10:
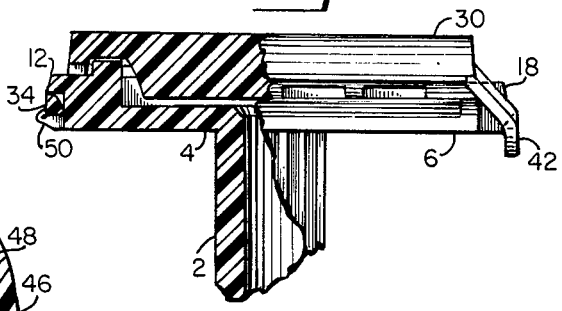
FIG. 10 is a front elevational view, partly broken away similar to FIG. 2 but showing the components in a different position.

Molded integrally with the platform portion 4 is a cap portion 30 (FIGS. 1–5) having a ridge 32 extending therefrom and adapted to enter the aforementioned center opening C of the razor blade B (FIG. 7). The cap portion 30 is provided at a first end thereof with a first cap locking means 34 (FIGS. 1–5) comprising a bar 36 having a curved surface 38 disposed between flat surfaces 37 and 39 normal to each other. The bar 36 is supported by a pair of fingers 40 extending from the first end of the cap portion. The curved surface 38 is engageable with the rounded edge 15 of the lip 14, as will be discussed below. The cap portion 30 is provided at a second end thereof with a second cap locking means 42 (FIGS. 1, 7–9 and 12) comprising a pair of legs 44 extending from the second end of the cap portion and interconnected by a bridge portion 46, the bridge portion 46, legs 44 and second end of the cap portion 30 defining an opening 48 adapted to receive the second platform locking means extension 20, as will be further discussed below.

Figure 4:
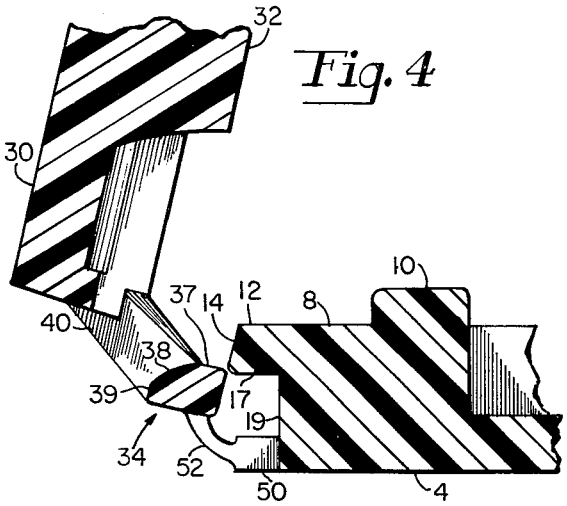
FIG. 4 is similar to FIG. 3, but showing the components in a different position.
Figure 5:
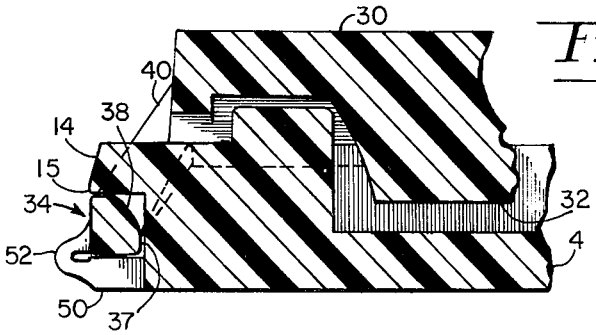
FIG. 5 is similar to FIG. 4 but showing the components in a still different position.

The safety razor further includes a hinge portion 50 (FIGS. 1–5) interconnecting the first end of the platform portion 4 and the first end of the cap portion 30. The hinge portion 50 includes a narrow-necked portion 52, which portion permits the flexure of the hinge portion, as shown in FIGS. 3 through 5 to accomodate movement of the cap portion 30 to a position overlying the platform portion 4.

Figure 2:
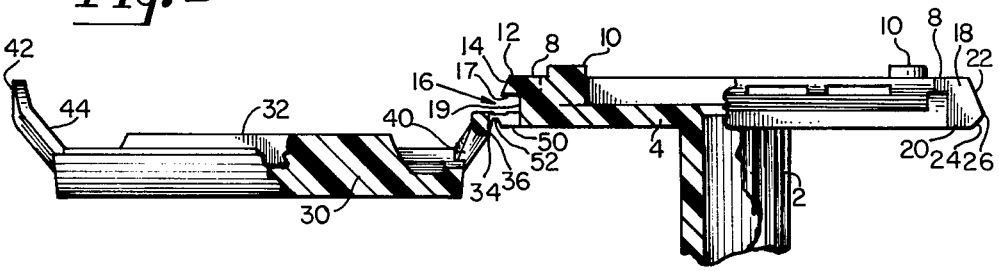
FIG. 2 is a front elevational view, partly broken away, of a portion of the razor shown in FIG. 1.
Figure 3:
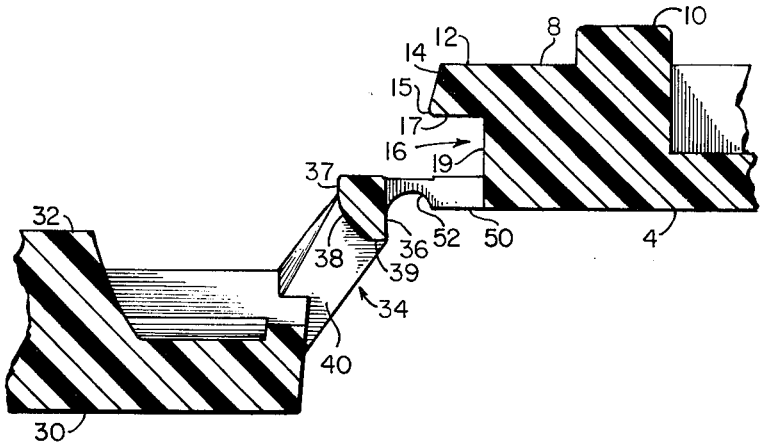
FIG. 3 is an enlarged sectional view of the hinge portion and a first locking portion of the safety razor.
Figure 6:
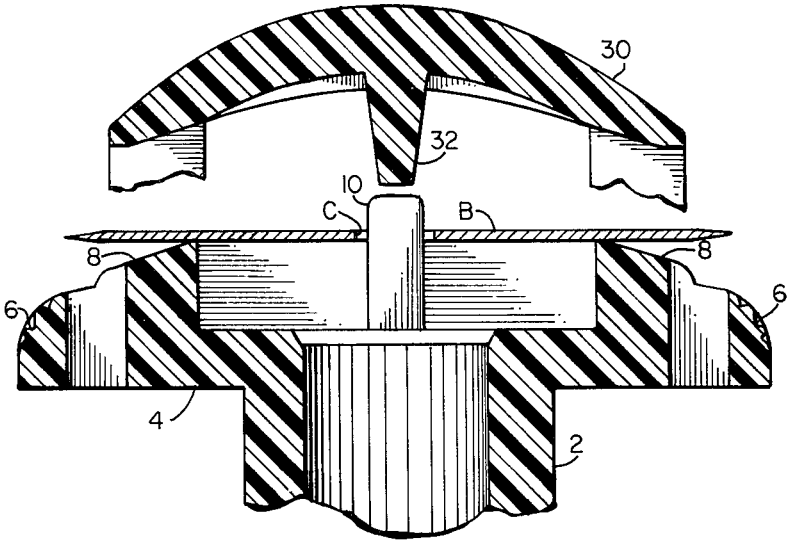
FIG. 6 is a sectional view of the head portion of the razor, the components being shown in position prior to locking of the cap and platform portions together.
Figure 11:
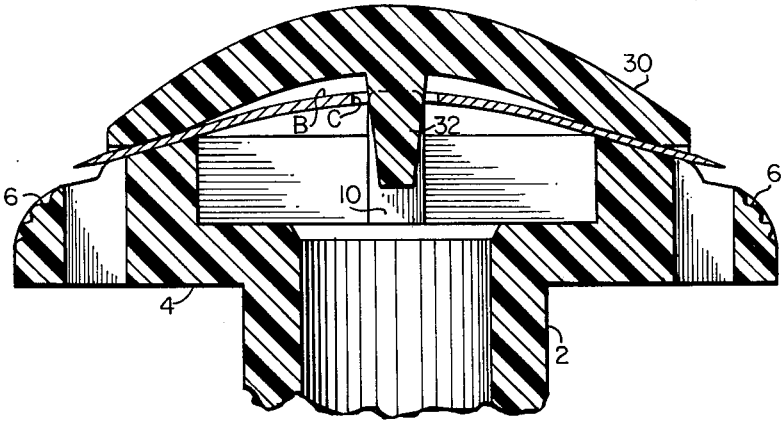
FIG. 11 is a sectional view similar to FIG. 6, but showing the components in a locked position.

In operation, the razor, as shown in FIGS. 1, 2 and 3 is in the open position and ready to receive a blade member B therein. The blade member B is placed upon the blade seat portions 8 of the platform portion 4, the projections 10 extending through the center opening C of the blade, as shown in FIG. 6. The cap portion 30 is then moved to a position overlying the platform portion 4. In doing so, the narrow-necked portion 52 of the hinge portion 50 flexes, as is shown in FIG. 4, to allow the cap portion to be moved to its overlying position. Further movement of the cap portion causes the second cap locking means 42 to approach the second platform locking means 18, as shown in FIG. 7. Upon still further movement of the cap portion 30, the legs 44 and bridge portion 46 of the first cap locking means 34 engages the first inclined surface 22 and upon application of pressure, rides over the ridge 26 to snap onto the second inclined surface 24, or to be put in another manner, the extension 20 snaps into the opening 48 of the second cap locking means 42. More or less simultaneously, the curved surface 38 of the first cap locking means 34 bears against the edge 15 of the lip 14 of the first platform locking means 12 until the bar 36 snaps into the recess 16 defined by the lip 14, as shown in FIG. 5. In the locked position, the surface 37 abuts the wall 19 and the surface 39 abuts the wall 17, solidly retaining the bar 36 in the recess 16. As the cap portion 30 bears against the blade member B, the ridge 32 of the cap portion 30 enters the center opening C of the blade, the ridge 32 being disposed between the projections 10. Referring to FIG. 11, it will be seen that seating of the cap portion 30 upon the platform portion 4 bends the blade B to an arcuate configuration.

The interlocking engagement of the first and second platform locking means 12, 18 with the first and second cap locking means 34, 42 securely fastens the cap portion 30 to the platform portion 4 at either end thereof. The hinge portion 50 is not depended upon for retention of the cap and platform portions together, once it has served its hinging function. Thus, the first end of the razor is securely held together without contribution from the hinge portion.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A safety razor comprising a handle portion, a platform portion molded integrally with said handle portion, a cap portion molded integrally with said platform portion, a hinge portion at a first end of said platform portion and a first end of said cap portion interconnecting said platform portion and said cap portion, said cap portion having first cap locking means at said first end thereof and second cap locking means at a second end thereof, said platform portion having first platform locking means at said first end thereof and second platform locking means at a second end thereof, said cap portion being adapted by flexure of said hinge portion to overlie said platform portion, said first cap locking means being engageable with said first platform locking means to securely fasten said first cap end to said first platform end, and said second cap locking means being engageable with said second platform locking means to securely fasten said second cap end to said second platform end.

2. The invention according to claim 1 in which said first platform locking means comprises a lip extending outwardly from said first end of said platform portion and defining a recess thereunder, and said first cap locking means comprises a bar engageable with said recess to lock said first end of said cap portion to said first end of said platform portion.

3. The invention according to claim 2 in which said bar is provided with a curved surface engageable with said lip to guide said bar into said recess.

4. The invention according to claim 3 in which said lip is provided with a rounded edge portion engageable by said curved surface.

5. The invention according to claim 4 in which said bar is provided with first and second flat surfaces on either side respectively of said curved surface, said flat surfaces being normal to each other, said recess having first and second walls normal to each other, said flat surfaces being engageable with said walls respectively to securely anchor said bar in said recess.

6. The invention according to claim 1 in which said second platform locking means comprises an extension directed outwardly from said second end of said platform portion, and said second cap locking means comprises legs extending from said second end of said cap portion interconnected by a bridge portion to define an opening adapted to receive said extension.

7. The invention according to claim 6 in which said extension is provided with a first inclined surface and a second inclined surface defining a ridge, said first inclined surface being adapted to be engaged by said bridge portion, and upon application of pressure, to guide said bridge portion over said ridge, whereby to facilitate said bridge portion snapping onto said second inclined surface.

8. The invention according to claim 1 including projections upstanding from said platform portion and adapted to enter a central opening of a blade member, and ridge means depending from said cap portion and adapted to enter said central opening of said blade member.

9. The invention according to claim 5 in which said second platform locking means comprises an extension directed outwardly from said second end of said platform portion, said extension having a first inclined surface and a second inclined surface defining a ridge, and said second cap locking means comprises legs extending from said second end of said cap portion interconnected by a bridge portion, said first inclined surface being adapted to be engaged by said bridge portion and, upon application of pressure, to guide said bridge portion over said ridge, whereby to facilitate said bridge portion snapping onto said second inclined surface.

10. The invention according to claim 9 including projections upstanding from said platform portion and adapted to enter a central opening of a blade member when said blade member is rested on said platform portion exposed, and ridge means depending from said cap portion and adapted to enter said central opening of said blade member when said cap portion is locked to said platform portion.

* * * * *